United States Patent [19]

Casler

[11] Patent Number: 5,015,926

[45] Date of Patent: May 14, 1991

[54] ELECTRONICALLY CONTROLLED FORCE APPLICATION MECHANISM FOR EXERCISE MACHINES

[76] Inventor: John A. Casler, 1605 Manzanita La., Manhattan Beach, Calif. 90266

[21] Appl. No.: 474,546

[22] Filed: Feb. 2, 1990

[51] Int. Cl.[5] ..... A63B 21/5

[52] U.S. Cl. ..... 318/9; 272/125; 272/129

[58] Field of Search ..... 318/9, 11, 12, 14, 558; 128/25 R; 272/125, 126, 127, 128, 129, 130, 131, 132, 135, 143, DIG. 4, DIG. 6

[56] References Cited

U.S. PATENT DOCUMENTS

| | | | |
|---|---|---|---|
| 4,276,887 | 7/1981 | Hofstein | 272/DIG. 6 X |
| 4,628,910 | 12/1986 | Krukowski | 272/129 X |
| 4,647,039 | 3/1987 | Noffsinger | 272/125 |
| 4,678,184 | 7/1987 | Neiger et al. | 272/132 X |
| 4,709,917 | 12/1987 | Yang | 272/129 X |
| 4,726,582 | 2/1988 | Fulks | 272/129 |
| 4,765,315 | 8/1988 | Krukowski | 272/125 X |
| 4,842,274 | 6/1989 | Oosthuizen et al. | 272/125 X |
| 4,848,152 | 7/1989 | Pratt, Jr. | 272/129 X |
| 4,869,497 | 9/1989 | Stewart et al. | 272/129 |

*Primary Examiner*—Bentsu Ro

*Attorney, Agent, or Firm*—Philip D. Junkins

[57] ABSTRACT

A force development system for the application of controlled variable speeds and torque forces in exercise machines utilized to strengthen and develop body muscles of an exercising person. The system includes a constant speed high torque electric drive motor mechanically coupled to a dynamic clutch device in which the controlled coupling of the rotary force input assembly of the clutch to the rotary force output assembly of the clutch is accomplished via electromagnetic coil activation of metallic powder particles forming coupling particle chains between the input and output assemblies of the clutch. Alternatively, the dynamic clutch of the system may be a fluid clutch containing electrorheological fluid.

The force development system of the invention also includes a speed reduction device between the dynamic clutch and the exercise machine to which the system is applied. An electronic sensor, interconnected to a microprocessor, senses the speed, motion and torque force of the system's output shaft. A control unit (interconnected to the drive motor, the electromagnetic coil of the dynamic clutch and the microprocessor) is directed by the microprocessor (in relation to the speed and torque force information sensed by the electronic sensor) and in turn controls the coupling torque of the dynamic clutch whereby controlled variable speeds and resistive forces are applied to the resistive force mechanism of the exercise machine.

9 Claims, 1 Drawing Sheet

ELECTRONICALLY CONTROLLED FORCE APPLICATION MECHANISM FOR EXERCISE MACHINES

BACKGROUND OF THE INVENTION

1. Field of the Invention

The present invention relates to physical exercise machines and devices. More particularly, the invention relates to an electronically controlled force production and force control mechanism and methodology for use with numerous types of exercise machines.

The skeletal-muscular system of the human body consists of the 206 bones and over 650 muscles that maintain the skeletal structure, protect and support the internal organs, and help the body move. During recent years there has been a great deal of interest shown in the regular and systematic exercise of important body muscles for the development of specific strengths and physical abilities, for the development of desired body shapes and proportions, and for the general maintenance of body health. Particular attention has been devoted to the development of the chest muscles (pectoralis major), back muscles (trapezius), upper arm muscles (biceps and triceps) and principal leg muscles (quadriceps femoris) through weight lifting and force application and resistance exercise programs and machines. Amateur and professional athletes and body builders, both male and female alike, spend many hours per week in such exercise programs utilizing a broad range of apparatus from simple barbells to complex and sophisticated exercise machines.

2. Prior Art

Conventional Exercise Machines. Past and present resistance or force type exercise machines typically utilize the force of gravity acting on a stack of weights to apply a resistance force to the movement of a body part to strengthen the muscles controlling such part. The machine user selects the number of weights desired for stressing the muscles involved in the movement of the body part in question. Alternatively, weights may be supported at variable distances along a force beam whereby the resistance force applied to the user's body part is increased by the distance at which the weight is positioned from the pivot point of the force beam. Also, resistance to movement force is often varied during certain ranges of the exercise motion by utilizing a cam to vary the effective weight of a weight stack or the length of a force moment arm of the device.

The greatest deficiencies of the present exercise machines are that they are subject to the effects of gravity, friction and inertia. The combination of these three forces causes the actual user-experienced force to be less than predictable except within very limited performance parameters. None of the present day exercise machines have the ability to substantially increase or decrease the selected applied force other than by the slight variation caused by the changing leverages resulting from changes in the position of a cam. None offers an accurate predictable force at varied exercise speeds of rates and none have the ability to offer a corresponding increase in resistance for the negative (eccentric contraction) stroke or motion when the exercised muscles are lengthening compared to the positive (concentric contraction) stroke or motion when the exercised muscles are shortening.

Electronic Art. Recently, several electronically controlled exercise machines have been introduced to the body exercise machine market. Their forces are created by: a) an electromagnetic braking system; b) a hydraulic force system; c) a pneumatics force system; or a D.C. motor used as a dynamic brake.

The electromagnetic braking systems offer "concentric only" resistance. This type of exercise machine targets the weakest force generated by a muscle and consequently the results from the exercise machine are limited to the low force concentric contraction (shortening) of the muscles. As a result, the maximum "overload tension" force available through controlled utilization of high eccentric contractions is not allowed. This limitation also prevents any positive result from the exercise movement other than from the concentric motion or stroke and therefore is a technological regression.

The air hydraulics or pneumatics system and the fluid hydraulics system of applying resistance forces in exercise machines have been utilized by several manufacturers. These machines allow performance of both eccentric and concentric force contractions. They utilize air or fluid pressure and mechanical linkages or leverage systems to provide the resistance forces against which exercise forces are applied by the user. Both systems are quite expensive to produce and their overall speed and force potential are not seen to be controllable to the extent of the mechanism of the present invention. Further, these systems are often large and bulky and they have a potential for fluid leaks, having bubbles in their fluid channels, and they require systematic maintenance to assure correct operation.

The D.C. motor has recently been utilized as a dynamic braking device in exercise machines. This method of producing a resistance force is rather basic and in its present state is not easily adaptable to even simple force curves. Further, exercise machines with dynamic braking devices have a problem with inertia and thereby may be less safe in their operation. Inertia also reduces response time to electronic commands from the control system and consequently reduces the performance envelope of the mechanism.

SUMMARY OF THE INVENTION

No single exercise device is in use today that has the capabilities needed to utilize the current body of scientific information and knowledge relating to muscle physiology. It is clear that to advance and expand the art of muscle development it is necessary to provide an adequate and precise applied or resistive force mechanism that is capable of instantaneously sensing and responding to user (the exerciser) and machine created commands, forces and movements. More specifically, the mechanism and methodology of the present invention creates, controls and transmits a precise and adjustable applied or resistive force that can substantially increase the muscle development results from an exercise due to the mechanism's capability of utilizing more specific physiology relating to the body area and muscles being exercised. Thus, the mechanism of the invention and the methodology thereof can be used to provide an alternative applied or resistive force in exercise machines similar to the ones that currently use gravity on a weight stack or on a weighted moment arm, i.e., the exercise machines now commonly used throughout the exercise industry.

It is therefore a principal object of the present invention to provide a scientifically based and precisely controlled force transmission mechanism and methodology that, when used correctly, will yield substantially greater results in physical muscle development of the person using the exercise machine to which the mechanism is applied.

A more specific object of the invention is to create a mechanism and methodology which allow improved performance parameters in the creation and control of force applied to exercise machines.

The force creation system of the present invention responds to electronic input to generate the programmed optimum applied or resistive force to the user. The force transmission unit of the system is electronically sensitive and responds in a matter of milliseconds to computer or microprocessor commands. A gear reduction unit amplifies motor torque and reduces motor RPMs to a usable range. The output or applied force of the system is then transmitted to any of a variety of exercise machines to which the mechanism is applied. Motion and force information is monitored by a closed loop electronic sensing unit that receives its input information from the output drive shaft or derive means of the system. The sensed motion and force information is transmitted to the control unit that in turn interprets the sensed information via the microprocessor and sends commands tot he force transmission group of devices (electric motor, magnetic particle clutch and gear reduction unit) of the mechanism as directed by the software program in the electronic control unit.

Improved muscle development results are derived from the application of the mechanism and methodology of the present invention to exercise machines because of the ability of the mechanism to extend the performance envelope and allow the introduction of more advanced physiological principles into an exercise program. Such principles or capabilities, as described below, have not previously been fully utilized in present day exercise machines due to the fact that such machines do not have the sensitivity, force response and control capabilities of the mechanism of the present invention. Thus, the mechanism of the invention has the full capability to sense and respond to various types of input information such as force and speed information. The mechanism and methodology of the invention will, as it is structured and applied, provide the following performance capabilities:

a) True isotonic capability. The device and methodology offers isotonic repetitions that are performed against controlled present forces. The speed will vary according to how much additional force is applied by the user. In most cases, however, the desired effect will not be truly isotonic which means tracking a linear force constant with speed variable conforming to the user's input force, but a force tracking of a programmed force curve with speed variable conforming to the user's input force.

b) True isokinetic capability. The device and methodology can also control the maximum speed of the exercise repetitions regardless of the force applied.

c) Isotonic/isokinetic capabilities. The mechanism of the invention can also allow minimum preset forces to be programmed that must be overcome to initiate and complete each repetition where the maximum speed of the repetition is preset.

d) Concentric/eccentric capabilities. The device and methodology allows both concentric motions (muscles shortening) and eccentric motions (muscles lengthening) with accommodating or programmable forces.

e) Isotonic concentric/isokinetic eccentric capabilities. The mechanism of the invention allows controllability to the point that concentric motions can be performed isotonically (controlled force) while eccentric motions are performed isokinetically (controlled speed). This combination of factors yields the maximum utilization of the inventions technology.

f) Instantaneously accurate force pattern tracking. The magnetic dynamic force transmission device (magnetic particle brake) component of the mechanism of the invention is controlled by a microprocessor or computer that constantly monitors created forces through a closed loop force monitoring component of the mechanism. Thus, the created forces are instantaneously adjustable.

g) Instantaneous speed sensing capability. The speed monitoring system (part of the closed loop monitoring component) detects any increase or decrease in what is considered normal speed performance in all operational modes and has the ability to instantly reduce all forces to zero. This system component is similar in structure and function to the ABS braking system utilized in automobiles and makes exercise machines to which the mechanism and methodology of the present invention are applied, the safest ever produced.

BRIEF DESCRIPTION OF THE DRAWING FIGURE

The foregoing and other features and advantages of the invention are illustrated in the accompanying drawing figures in which:

FIG. 1 shows the mechanism components of the invention in schematic form including appropriate interconnection between components with the magnetic particle clutch component of the mechanism shown in cross section; and FIG. 2 is a cross sectional view an electrorheological (ER) fluid clutch which may alternatively be used in the mechanism of the invention in substitution for the magnetic particle clutch component of FIG. 1.

DETAILED DESCRIPTION OF THE INVENTION

Figure 1:
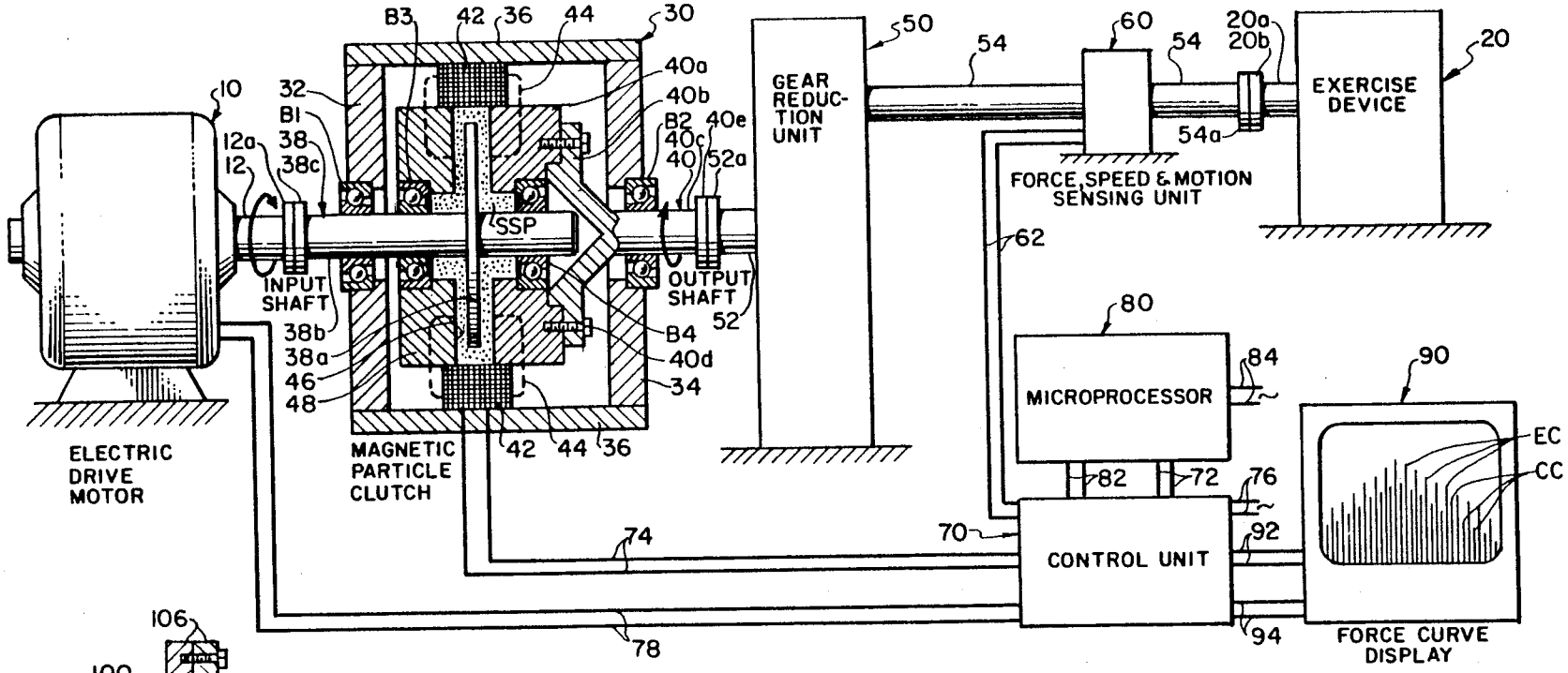

A preferred embodiment of the mechanism of the present invention is shown in the schematic drawing of FIG. 1. A force creation device 10 is shown as an electric drive motor. The device used to drive the system must be of sufficient power to supply the needed amount of torque or force through the system to an exercise machine 20 of any of the well-known types used for the development of body muscles. The force created by the force creation device 10 of the system is transmitted through a shaft 12 (or other force transmission means) to a dynamic clutch device 30 which is illustrated in FIG. 1, in a sectional presentation, as a magnetic particle clutch, as described hereinafter. The dynamic clutch device 30 of the force mechanism of the invention may also be comprised of an electrorheological fluid clutch device of known design (see FIG. 2) or similar device that has precision electronic controllability.

As illustrated in drawing FIG. 1, the magnetic particle clutch device 30 is comprised of: a housing including a front end plate 32, a rear end plate 34 and an annular casting 36; a force input disc-shaft assembly 38; a force output assembly 40; and an annular stationary coil 42 for creating magnetic flux lines represented by dashed lines 44.

The clutch housing, force input and force output assemblies 38 and 40, and the stationary electric coil 42 of FIG. 1 are configured and positioned so as to form a central cavity 46 within which the disc portion 38*a* of assembly 38 is supported by shaft portion 38*b*. The cavity 46 is defined on one side of disc portion 38*a* by annular ring 48 and on the other side by ring portion 40*a* and its supporting annular portion 40*b* of the force output assembly 40 which includes force output shaft portion 40*c*. The disc portion 38*a* of the force input assembly is seated centrally within the cavity 46 and never touches the internal sides of annular rings 48 and 40*a* or the internal surface of coil 42. The gaps between the disc 38*a* and the annular rings 48 and 40*a* and between the perimeter of disc 38*a* and the coil 42 are filled with fine, dry, stainless steel powder SSP. The powder is free flowing until a magnetic filed is applied via the stationary electric coil 42. With the powder applied to coil 42, the powder particles form into chains along the magnetic field lines, linking the disc 38*a* to the annular rings 48 and 40*a* and applying a coupling torque action that is proportional to the applied input current of the coil 42.

The disc-shaft assembly 38 includes shaft portion 38*b* which comprises the force input end of the clutch assembly 30 and force output assembly 40 includes shaft portion 40*c* which comprises the force output end of the clutch assembly. The shaft portion 38*b* extends beyond the disc portion 38*a* as shaft portion 38*c*. The force input assembly 38 is supported in its passage through end wall 32 by a sealed bearing B1 and the force output assembly 40 is supported in its passage through end wall 34 by a sealed bearing B2. The assemblies 38 and 40 are rotatably supported within the clutch housing by sealed bearings B3 and B4. During operation of the clutch device 30 the force input shaft 38*b* is driven at a constant speed by the drive motor (as shown in FIG. 1). When the coil 42 is not energized the disc portion 38*a* of the force input assembly turns with shaft 38*b* freely within the cavity 46 of the clutch assembly 30. With the application of electrical power to coil 42 the output assembly 40 rotates in the same direction as the input shaft at a speed dependent upon the magnitude of the torque tension developed between the disc 38*a* and the annular ring 40*a* of the force output assembly 40. The ring 48 also rotates in like fashion with respect to the disc 38*a*. The ring portion 40*a* and its supporting portion 40*b* may be affixed to one-another in any convenient manner such as by bolts 40*d*.

Magnetic particle clutches of the type illustrated in the drawing FIG. 1 provide smooth, silent, and clean tensioning torque between their force input assemblies and their force output assemblies. Since their input and output assemblies engage magnetically, there are no friction plates to wear and give off wear produce or grip or squeal. Further, since there is no wear, there are no adjustments to be made of slip rings to replace. Tensioning torque can be varied infinitely from near zero to maximum rated torque by varying the coils input current and significant changes in tensioning torque can be made in extremely fast fashion. Output shaft inertia is very low, so acceleration is ultra-fast. A magnetic particle clutch device 30 of the type illustrated has been incorporated in the preferred embodiment of the system of the present invention because of its commercial availability and its linear output response to control input via electric current levels. The input portion 38*b* of the disc-shaft assembly 38 is connected by appropriate coupling means 38*c* to the output shaft 12 of motor 10 by coupling means 12*a*. The output portion 40*c* of the force output assembly 40 is connected by appropriate coupling means 40*e* to the input shaft of a gear reduction unit 50.

The dynamic clutch device 30 of the system determines how much of the force generated by the force creation device 10 is transmitted to a reduction gear unit 50 of the overall force application mechanism or system of the invention. The output shaft 40*c* of the clutch device 30 is mechanically connected, via shaft flange 40*e*, to the input shaft 52 of the gear reduction device through its end flange 52*a*. The gear reduction unit 50 of the system is preferably a commercially available enclosed gear reduction box although it is feasible to use a small drive gear affixed to the output shaft portion of the magnetic particle clutch device in combination with a chain drive to a larger gear affixed to the drive shaft transmitting power to the exercise device.

The force which has been multiplied by the gear reduction unit 50 is transmitted through an output shaft 54 to any rotary type motion exercise machine 20 of common design (leg curl, leg extension, biceps curl, etc.) either directly via shaft linkage or through a single gear drive or series of gears and chains. For linear exercise motions (overhead presses, bench presses, leg presses, etc.) sliding mechanisms of various types can be connected (via chain drives, guide rods, toothed means, etc.) between the gear reduction unit 50 and the exercise machine 20 to obtain the benefits of the present invention. Utilizing any of the various connection means, the system can transmit force to the exercise machine comparable to the force applied by a weight stack at the end of a cable or guide rod.

In accordance with the present invention a force, speed and motion sensing unit 60 (of known design) is applied to the output shaft 54 of the gear reduction device 50, such output shaft (as shown in the drawing FIG. 1) being connected to the force input means 20*a* of the exercise machine 20. Where the force input means for the exercise machine is a power shaft, connection can be made via appropriate flanges 54*a* and 20*b*, respectively, of the shaft 54 and the shaft 20*a*. the force and motion sensing unit 60 is connected via leads 62 to a closed loop electronic control system forming a part of the system's control unit 70. The closed loop control system of control unit 70 sends precise force and motion input information via electrical leads 72 to a microprocessor 80. The microprocessor in turn processes the input information and creates control output information that is directed, via electrical leads 82, through the control unit 70 and to the dynamic clutch system 30 (via electrical leads 74) for regulating with great precision and speed the resistive forces applied to the exercise machine 20.

Electrical power for the microprocessor 80 is supplied through power leads 84 and power for control unit 70 is supplied through power leads 76. The control unit in turn supplies power to the electric motor drive 10 via leads 78. Preferably, the drive motor 10 is a D.C., constant speed, motor of high output torque design. A display unit 90 (CRT display device is interconnected via electrical leads 92 to the control unit 70 for the display of the force curves generated by the mechanism of the invention, i.e., for example an eccentric contraction curve EC and a concentric contraction curve CC. Electrical power for the display unit 90 is derived via leads 94 from the control unit 70. The display unit 90 may, alternatively, be a liquid crystal type of display device (LCD), a light emitting diode type of display device (LED), or a chart recorder, all of known design.

The force of the output shaft 40c of clutch 30 is applied to the interconnected exercise machine (as shown in FIG. 1) and the exercising person using the machine applies a counter rotational force tending to make the force output assembly of the clutch slip with respect to disc 38a. In some instances the concentric contraction force applied by the exerciser may result in the output assembly 40 slip with respect to the disc 38a to the extent that the output shaft portion 40c of the clutch assembly actually turns in a direction opposed to the rotational direction of the input shaft portion 38b. In such instances, the exercise program (as controlled by the microprocessor and software programing) may provide for an increase in the electrical power level within coil 42 and thereby increase the tension torque developed within the clutch in opposition to the exerciser's body movement.

Figure 2:
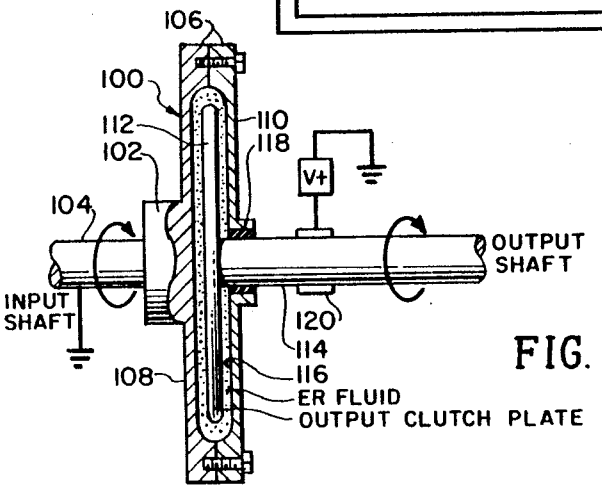

In FIG. 2 there is illustrated another alternative fluid clutch device applicable to the power generation system of the invention. The clutch 100 comprises a fluid clutch designed to operate with electrorheological (ER) fluids which change flow characteristics when an electrical field is applied between the electrodes of the clutch device. Response, which takes only milliseconds, is in the form of a progressive gelling of the ER fluid that is proportional to field strength. With no field present, the fluid flows as freely as water or hydraulic oil. If the electrified ER fluid gel is sheared with sufficient force, it flows. But when the applied shear force is below a critical value, the gel reacts as a solid with measurable stiffness.

The force input assembly 102 of the ER fluid clutch is comprised of a grounded force input shaft and an input clutch housing 106 having a principal housing wall portion 108 and a cover portion 110. Within the clutch housing 106 there is located a clutch plate 112 (spaced from the housing wall 108 and cover portion 110) which is affixed to and has extending therefrom a force output shaft 114. The clutch housing 106, as structured, presents a cavity 116 within which the clutch plate 112 may rotate. Within the cavity 116 and surrounding the clutch plate 112 there is provide an appropriate ER Fluid comprised of a carrier fluid such as silicone oil, mineral oil, or chlorinated paraffin and in which particles (generally 1 to 100 miromillimeters in diameter) such as polymers, minerals, or ceramics are suspended.

The force output shaft 114 of the ER fluid clutch is provided with appropriate seal and bearing means 118 to maintain the ER fluid within the housing. A slip ring assembly 120 is also applied to the force output shaft 114 through which electrical energy from grounded voltage source V+ is fed to establish an adjustable potential between the clutch plate 112 (acting as one electrode) and the clutch housing 106 (acting as the other electrode of the device). When an electric field is applied across the ER Fluid, positive and negative charges on the particles respond by separating, so each particle then has a positive end and a negative end. As a result, the particles are attracted to each other, forming chains between the electrodes (similar to the way stainless steel powder aligns in a magnetic particle clutch) and creating a torque tension between the clutch plate 112 and the housing 106 forming an electrified ER fluid gel which reacts as a solid with substantial stiffness. Thus, an ER fluid clutch is substantially the equivalent of the magnetic particle clutch previously described in connection with FIG. 1.

The foregoing descriptions of preferred embodiments of the invention have been presented for the purpose of illustration only. They are not intended to be exhaustive or to limit the invention to the precise forms disclosed. Many modifications and variations are possible in the light of the above teachings. It is intended that the scope of the invention be limited not by the foregoing detailed descriptions thereof, but rather by the claims appended hereto.

It is also to be understood that the mechanism and methodology of the invention can be utilized with any type of exercise machine that currently utilizes a weight stack or a weighted lever arm. It can be directly attached to rotary types of machines or connected via known mechanical means to linear motion exercise machines. It can be used with individual commercially available exercise machines of the type sold under the brand names "Nautilus", "Eagle", or "Universal". The mechanism and system of the invention can also be adapted to many home gym exercise machines. Finally, it is believed that the system can also be adapted for ergometric usage with rowing machines, bicycles, treadmills, steppers, climbers, endless stair units and other types of exercise devices that require precise control of force and/or motion in their utilization.

What I claim is:

1. A force development system for the application of controlled variable speeds and torque forces in exercise machines utilized to strengthen and develop body muscles of an exercising person, comprising:

a) a constant speed high torque force creation device including a primary rotary force output shaft;

b) a dynamic clutch device including a rotary force input assembly interconnected to the primary rotary force output shaft of said torque force creation device for driving said clutch device, a rotary force output assembly including a secondary rotary force output shaft, and means for the controlled coupling of said rotary force output assembly to said force input assembly;

c) a speed reduction and torque amplifying device including force input means interconnected to the secondary rotary force output shaft of said clutch device, means for reducing the speed and amplifying the torque of the force input means of said speed reduction and torque amplifying device, and a tertiary rotary force output shaft of reduced speed with respect to the speed of said primary and secondary force output shafts, the tertiary output shaft of said speed reduction and torque amplifying device being mechanically interconnected with the force mechanism of an exercise machine for applying variable active and passive torque force to the exercising person using said machine;

d) electronic sensor means associated with the tertiary rotary force output shaft of said speed reduction and torque amplifying device for sensing the speed, motion and torque of said tertiary output shaft and the opposing torque force and motion of an exercising person as applied to said output shaft;

e) microprocessor means electrically interconnected to said electronic sensor means for receiving the speed, motion and torque force information sensed by said sensor means; and f) control means electrically interconnected to said force creation device, to the controlled coupling means of said dynamic clutch device, and to said microprocessor means, said control means being directed by said microprocessor in relation to the speed, motion and torque force information sensed by said sensor means to operate and control said force generation device and to operate and control the controlled coupling means of said clutch device whereby controlled variable speeds and active and passive torque forces are applied to the force mechanism of the exercise machine in direct relation to the force applied to said mechanism by the exercising person during the active and positive force motion and passive and negative force motion of an exercise.

2. A force development system for the application of controlled variable speeds and torque forces in exercise machines as claimed in claim 1 wherein the constant speed high torque force creation device is an electric drive motor.

3. A force development system for the application of controlled variable speeds and torque forces in exercise machines as claimed in claim 1 wherein the means for reducing the speed of the input means of the speed reduction and torque amplifying device is a gear train interposed between said force input means and the tertiary rotary force output shaft of said speed reduction and torque amplifying device.

4. A force development system for the application of controlled variable speeds and torque forces in exercise machines as claimed in claim 1 wherein the dynamic clutch device is a magnetic particle clutch in which the means for the controlled coupling of the rotary force output assembly of said clutch to the rotary force input assembly of said clutch comprises a contained volume of metallic powder particles interfacing said input assembly and said output assembly and activatable by the magnetic force of an electromagnetic coil to form particle chains between said assemblies to apply coupling torque action therebetween, said magnetic force and the torque coupling action within said clutch being proportional to electrical current supplied to said coil by the control means of said force development system.

5. A force development system for the application of controlled variable speeds and torque forces in exercise machines as claimed in claim 4 wherein the rotary force input assembly of the magnetic particle clutch comprises a shaft bearing a disc situated within the contained volume of metallic powder particles and interfacing the rotary force output assembly of said clutch, said metallic powder particles when activated by the electromagnetic coil of said clutch forming particle chains between said disc and said force output assembly to apply coupling torque action between the disc of said force input assembly and said force output assembly.

6. A force development system for the application of controlled variable speeds and torque forces in exercise machines as claimed in claim 1 wherein the dynamic clutch device is a fluid clutch in which the means for the controlled coupling of the rotary force output assembly of said clutch to the rotary force input assembly of said clutch comprises a constrained volume of electrorheological fluid interfacing said input assembly and said output assembly and activatable by an electrical field applied between said force input and output assemblies acting as electrodes to cause a gelling of said fluid to apply coupling torque action therebetween, said gelling of said fluid and the torque coupling action within said clutch being proportional to the electrical field applied between said assemblies by the control means of said force development system.

7. A force development system for the application of controlled variable speeds and torque forces in exercise machines as claimed in claim 6 wherein the rotary force input assembly of the fluid clutch comprises a shaft bearing an annular housing containing a volume of electrorheological fluid and the rotary force output assembly of the fluid clutch comprises a shaft bearing a disc situated within said housing, said electrorheological fluid when activated by an electrical field applied between the housing of said force input assembly and the disc of said force output assembly acting as electrodes causes a gelling of said fluid to apply coupling torque action between the housing of said force input assembly and the disc of said force output assembly.

8. A force development system for the application of controlled variable speeds and torque forces in exercise machines as claimed in claim 1 wherein a display unit is electrically interconnected to the control means of said force development system for the display of force curves representing the forces applied by an exercising person to the force mechanism of the exercise machine to which said force development system is applied.

9. A force development system for the application of controlled variable speeds and torque forces in exercise machines as claimed in claim 8 wherein the display unit is a force curve display device selected from the group consisting of CRT type display devices, liquid crystal type display devices, light emitting diode type display devices, and chart recorded type display devices.

* * * * *